US005474127A

United States Patent [19]

White

[11] Patent Number: 5,474,127

[45] Date of Patent: Dec. 12, 1995

[54] ANNULAR SAFETY SYSTEM FOR OIL WELL

[75] Inventor: Pat M. White, Carrollton, Tex.

[73] Assignee: Halliburton Company, Carrollton, Tex.

[21] Appl. No.: 989,752

[22] Filed: Dec. 14, 1992

[51] Int. Cl.[6] ..... E21B 23/02; E21B 23/04; E21B 33/124

[52] U.S. Cl. ..... 166/120; 166/191; 166/212; 166/217

[58] Field of Search ..... 166/120, 123, 166/216, 341, 348, 372, 191, 212, 217

[56] References Cited

U.S. PATENT DOCUMENTS

| | | | |
|---|---|---|---|
| 3,946,807 | 3/1976 | Amancharla et al. | 166/123 |
| 4,051,896 | 10/1977 | Amancharla et al. | 166/123 |
| 4,153,108 | 5/1979 | Pounds et al. | 166/120 |
| 4,256,180 | 3/1981 | Mott | 166/322 X |
| 4,258,787 | 3/1981 | Amancharla et al. | 166/120 |
| 4,258,792 | 3/1981 | Restarick | 166/315 |
| 4,333,531 | 6/1982 | Lawson | 166/341 |
| 4,682,656 | 7/1987 | Waters | 166/372 |
| 4,878,539 | 11/1989 | Anders | 166/303 |
| 4,930,573 | 6/1990 | Lane et al. | 166/120 |
| 5,048,610 | 9/1991 | Ross et al. | 166/372 |
| 5,113,939 | 5/1992 | Ross et al. | 166/120 |
| 5,117,906 | 6/1992 | Giusti, Jr. et al. | 166/120 |

OTHER PUBLICATIONS

Otis Products and Services Catalog Index, p. 3, ©1989 Otis Engineering Corporation.

Otis Products and Services Catalog, Packer Completion Accessory Equipment Section, Landing Nipple Liner Hangers, p. 77, ©1989 Otis Engineering Corporation.

*Primary Examiner*—Ramon S. Britts
*Assistant Examiner*—Frank S. Tsay
*Attorney, Agent, or Firm*—Jenkens & Gilchrist

[57] ABSTRACT

An annular safety system for an oil well. The annular safety system is in the form of a hanger mechanism. The hanger mechanism is particularly effective in an oil well equipped for gas lift operation where gas is injected into an annular space between the well casing and the production tubing in order to aerate produced oil migrating up the wellbore through the production tubing. The hanger mechanism includes a casing nipple which is run into the well with the casing and a stationary threaded tubing holder which is run into the well with tubing. The hanger mechanism includes a device which, upon running the stationary threaded tubing holder into the well through the casing nipple, secures the stationary threaded tubing holder in a particular position relative to the casing nipple and prevents upward and downward movement of the stationary threaded tubing holder relative to the casing nipple. The hanger mechanism also includes a device allowing the hanger mechanism to selectively, independently seal each of the annular space between the well casing and the production tubing to prevent flow of injected gas and produced oil from the wellbore. Further, the hanger mechanism includes a release mechanism which may be selectively activated to allow the stationary threaded tubing holder and other downhole equipment to be upwardly retrieved from the well.

25 Claims, 4 Drawing Sheets

ANNULAR SAFETY SYSTEM FOR OIL WELL

BACKGROUND OF THE INVENTION

1. Field of the Invention

The invention relates to safety equipment, for an underground petroleum production well, and, more particularly, to an annular safety system to prevent blowout of a well equipped for gas lift operation, said safety system including a wireline release hanger with gas injection mechanism and allowing for retrieval of the system and related downhole production equipment from downhole.

2. Description of the Related Art

Much of the petroleum well drilling and completion technology presently employed has been practiced for a number of years. In general, there are two drilling methods employed for drilling petroleum production wells. One type of drilling, termed cable tool drilling, is presently employed only infrequently. In cable tool drilling, a chipping tool attached to a cable is repeatedly lifted by the cable and then dropped onto a sedimentary formation to form a hole in the formation. The impact from dropping the tool chips ,away the sediments to create and deepen the hole to a desired depth. Cable tool drilling is generally effective only for very shallow drilling in particular, limited types of sedimentary formations.

A second type of drilling, referred to as rotary drilling, is the most common form of drilling employed today. Rotary drilling has today virtually replaced cable tool drilling. Rotary drilling was first employed in the United States sometime around the year 1900. In rotary drilling, the drilling action comes from pressing teeth of a drill bit firmly against a sedimentary formation and turning, or rotating, the bit. Several types of bits are commercially available, most having protruding teeth formed of a very hard material capable of cutting away at the sedimentary formations being drilled. At the same time this type of bit is rotated, a fluid, usually a liquid concoction of clay and water called drilling mud, is forced at great pressure out of special openings, or nozzles, in the bit. Due to the pressure, this mud jets out of the bit nozzles with great velocity. These jets of mud then move cuttings made by the bit teeth away from the teeth, and thereby continuously expose fresh, uncut sediments to the teeth. Once the cuttings are moved away from the bit teeth, the mud lifts the cuttings off the bottom of the hole cut by the drill and then carries the cuttings up the drilled hole to the ground surface for disposal.

The rotary drill can drill a subsurface hole to depths in excess of 20,000 feet. As the depth of a drilled subsurface hole increases, pressures encountered at the deepening bottom of the hole tend to rise. The pressures increase in this manner due, for example, to the weights of the sedimentary layers atop the depths. Due to the tremendous weights of sedimentary layers and other factors, pressures at the bottom of a well hole are often extremely high. Due to these tremendous pressures, oil and/or natural gas wells must typically be "completed" in some manner to prevent cave-in of the well hole and to allow for and control flow of oil and/or gas from deep sedimentary zones containing the oil and/or gas.

A wide variety of well completion methods and types are possible. In an example of a common arrangement, the well is "cased" and "cemented". The process of casing a well typically involves placing steel pipe, referred to as casing, within the drilled hole, i.e., wellbore, of an oil and/or gas well. The casing process is typically performed at particular intervals as drilling of a well progresses. The purpose of the process is to prevent the walls of the drilled hole from caving or sloughing during drilling and to provide a means for extracting oil and/or gas from downhole in the well if the well is determined to be sufficiently productive. The casing utilized in a particular instance for the process is typically smaller in outside diameter than the diameter of the drilled hole. Depending on the requirements for satisfactorily completing a particular well, there may be several strings of casing, one inside the other, placed in the wellbore.

Once the casing or a particular string thereof, as the case may be, has been inserted inside the wellbore of the drilled hole, the well is often then also cemented. The process of cementing a well usually involves pumping a liquid slurry of a special cement into the annular space formed between the casing and the wall of the drilled hole. In the typical cementing process, the cement is pumped through drillpipe positioned in the wellbore, to the bottom of the casing and up into the annular space. The cement is allowed to harden creating a drill hole wall comprising the casing pipe and cement.

Once a well has been cased and cemented, a special piping, commonly referred to as tubing, is often then run into the well inside the cemented casing. Tubing generally consists of a series of lengths of seamless pipe, each length having screw threadings at each end on the outside circumference thereof. The lengths are strung together in a series by couplings, which are short pipe fittings with both ends threaded on the inside circumference. The tubing, as inserted in the drilled hole, serves as a passageway for the migration of oil and/or gas from productive sedimentary formations at locations downhole.

Tubing strings are often of significant length since the strings must extend at least from the vicinity of those productive sedimentary formations to the ground surface. Strings of such length can be very weighty. These strings typically must be suspended in some manner from the well casing. If the tubing string is suspended from the top of the casing, that portion of the casing is subjected to the entire weight of the string. It is, therefore, desirable in the case of certain wells to instead suspend the tubing string from the casing at one or more vertical locations within the well, between productive formations and the ground surface. By so suspending the string at those one or more vertical locations within the well rather than at the top of the casing at the ground surface, the weight of the tubing string may be distributed along the vertical length of the casing.

A variety of presently available devices may be employed to effectively suspend a tubing string from well casing. Devices by which the tubing string may be so suspended are sometimes referred to as hangers. The heretofore available hangers typically are incorporated with the casing as the casing is inserted during the process of casing the well. Those hangers then serve to suspend the tubing string from desired locations along the length of the casing to prevent the tubing string from falling deeper into the wellbore. In the case of these heretofore available hangers, the tubing string is only prevented from falling deeper into the wellbore, not from moving upward in the wellbore towards the ground surface. That upward movement is possible because those heretofore employed hangers have not been equipped to also restrict upward movement of the tubing string. This is probably so, at least in part, because there has previously been no reason that restriction of upward movement of the string would be desired.

Further regarding the tubing string, the outside diameter of the tubing inserted in the drilled hole is usually smaller than the inside diameter of the casing. The result of these differing diameters is typically the existence of an annular space between the tubing and the casing along the corresponding lengths thereof. This annular space between the tubing and the casing can be selectively sealed by various packers to prevent the flow of produced oil and/or gas in the annular space. The term packer typically refers to some type of expanding plug which is positioned and then expanded mechanically, hydraulically, or by other means to seal off select sections of casing, for example, annular spaces between casing and tubing. A variety of types of packers are commercially available. Most available packers consist of a sealing device, a holding or setting device, and an inside passage for flow of fluids, such as oil and/or gas.

Once the wellbore is cased and cemented and tubing and packers, as desired, are positioned in the well hole, oil and/or gas production from the well may be commenced by making holes through each of the tubing, casing and cement in the vicinity of select regions of the sedimentary formations believed to contain producible quantities of oil and/or gas. The process of making those holes through the tubing, casing and cement is referred to as perforating the well. A variety of methods and devices may be employed to perforate the well. In a typical method, a perforating gun is employed. A perforating gun is a device which may be lowered through the tubing into the well hole and, in the common case, caused to shoot bullets or set off special explosive charges known as shake charges. The bullets or shake charges are caused by the gun to be discharged at various circumferential and vertical positions within the tubing. The discharged bullets or shake charges pierce the tubing, casing and cement and create pathways some distance into the sedimentary formation in the select regions.

Once a well has been perforated, oil and/or gas from the sedimentary formation in the regions of the perforations migrates through the formation into those pathways, then through the perforation holes in the cement and casing and into the tubing. Within the tubing, the oil and/or gas travels from the location of the perforations downhole, upwards to the surface of the ground. The oil and/or gas so migrates and travels upwards to the surface due to the pressure gradient from higher pressure at the productive sedimentary formation to progressively lower pressure towards the top of the well at the ground surface.

At the ground surface of the well, the top of the casing typically protrudes some distance above the ground forming the so-called casinghead. Various control valves and flow pipes are usually attached to this casinghead to confine, regulate and control the flow of produced oil and/or gas. These valves and pipes are often also equipped with a variety of pressure gauges and chokes to prevent blowout and leakage of the produced flows. A variety of types and configurations of these valves, pipes, gauges, chokes, and other devices are presently available to be employed with a well. Due to the branching arrangement of many of these configurations, the configurations are often referred to as Christmas trees.

Often, old wells, wells in particular locales, deep wells, and certain other wells require special operation procedures referred to as improved recovery techniques. There are a variety of these recovery techniques presently employed for oil wells. One such recovery technique is gas lift operation. Gas lift is the process of raising or lifting fluid from a well by injecting gas down the well through the tubing or through the tubing-casing annular space. The injected gas aerates the fluid being produced so that the fluid then exerts less pressure than that of the producing formation. Consequently, the higher pressure of the producing formation forces the fluid being produced through the tubing, from downhole in the vicinity of the producing formation towards the surface, thereby improving recovery of the fluid. In a gas lift system for gas lift operation of a well, gas may be injected continuously or intermittently, depending on the producing characteristics of the well and the particular arrangement of the gas-lift equipment.

As will hereafter be more fully described, in the typical gas-lift operation, the annular space between the tubing and casing is entirely filled with injected gas during gas-lift operation. In such an arrangement, a large amount of gas is present within this annular space at any given time. This large amount of gas in the annular space is believed to create certain potential operational hazards in some wells employing gas -lift techniques. One example of these potential hazards is leakage of injected gas from the well hole, for example, due to the wellhead being knocked off. Leaked gas could ignite, thereby also igniting the large amount of gas within the annular space. The result could be a destructive and potentially deadly explosion. Some believe the tremendous explosion and fire at the Piper Alpha site in the North Sea may have resulted from circumstances similar to those described.

Because of these and other potential hazards of gas lift operation of wells, various governmental regulatory and other restrictions have been imposed requiring in many cases that wells employing gas lift operation include certain safety mechanisms designed to reduce and/or eliminate the hazards. For example, North Sea oil operators must now include a form of annular safety mechanism in their North Sea well completions fitted for gas lift operation. Such an annular safety mechanism must serve to seal off flows from a well in the event of certain triggering occurrences indicative of particular potentially hazardous situations. Some operators in seeking to comply with those requirements have undertaken to position annular safety valves downhole which may serve to isolate and seal gas lift gas within the casing-tubing annular space. In those well arrangements employing annular safety valves, the well tubing is also affixed with a safety valve. Control equipment employed in those well arrangements can cause both the annular safety valves and the tubing safety valve to close, isolating gas and oil downhole, in the event of triggering circumstances indicative of hazardous situations. These previously employed annular safety valve/tubing safety valve arrangements, nevertheless, can present obstacles and difficulties to operators when performing various well workover and maintenance operations.

Well workover is a generic term used to describe one or more of a variety of remedial operations on a producing well to try to increase production. Well workover is a common operation performed by well operators. In many cases, workover operations require some type of downhole equipment which must be manipulated and activated downhole within the wellbore. Like workover operations, well maintenance and repair operations must also often be performed downhole within the wellbore. Maintenance and repair operations are typically directed to wellhead and downhole equipment in efforts to keep that equipment in proper working order. Some examples of workover and maintenance and repair operations are deepening, plugging back, pulling and resetting liners, and squeeze cementing. In each of these instances and in most others as well, various tools must be employed downhole within the wellbore in order to produce desired results from the operations.

Since well workover and maintenance and repair operations often require that certain activities be performed downhole within the wellbore, it is helpful to the operator if the well equipment arrangement allows relatively easy access to downhole areas. The annular safety valves/tubing safety valve arrangements heretofore employed in completing wells for gas lift operation can restrict and complicate workover and maintenance and repair procedures. In particular, in order to lower a tool downhole for many of these type procedures, the tool must be lowered into the well through the annular space between the casing and tubing or, if that is not possible, through the tubing string. If the operation is performed in the annular space between the casing and tubing by lowering a tool into that annular space, the valve arrangements of those wells so completed require that the operator remove the entire annular safety valve mechanism from the wellbore to allow passage of the tool. If, on the other hand, the annular space between the casing and tubing can not be entered to perform the downhole operation, then the operation must be performed by entering the tubing string to reach the downhole region for the operation. When a tool is lowered into the wellbore through the tubing, the tubing can be damaged by the tool or may present obstacles to passage of the tool, for example, due to sludge and other crud which has accumulated in the tubing from produced fluids. In either case of operations in the annular space or in the tubing, the previously employed valve arrangements in wells completed for gas lift operation present problems to the operator.

Further, downhole safety valves, such as the annular safety valves and tubing safety valves employed by operators in gas lift operations, tend to be the equipment likely to wear out and require maintenance in most wells. The annular safety valve/tubing safety valve arrangements heretofore employed in wells completed for gas lift operation make replacement of those valves an involved and costly procedure. In particular, the wells must be sealed off in some manner to prevent flow of the pressured oil and gas from the well as the valves are removed. This sealing off is a particular problem when the annular safety valves must be replaced or repaired. In that case, a mechanism separate from those valves must be employed to retain injected gas lift gas within the annular space between the casing and tubing to prevent the gas from escaping the wellbore. As previously briefly mentioned, the typical completion arrangements of these wells do not provide a means which prevents the downhole equipment of the well from being raised within the wellbore. Also as hereinbefore briefly mentioned, the volume and pressure of the injected gas in the annular space between the casing and tubing is typically quite great. Consequently, any mechanism employed to retain the gas within the wellbore of these wells must be operable independent of the annular safety valves being serviced, must be sized to precisely seal off the wellbore and yet be strong and reliable to overcome and retain the great gas volume and pressure, and can not rely upon affixation to the downhole equipment of the well as that equipment has not been secured within the wellbore to prevent the equipment from being raised. The previously available mechanisms for use in those situations with these wells completed for gas lift operation have not proven adequate.

Finally, in those previous annular safety valves/tubing safety valve arrangements in wells completed for gas lift operation, the tubing safety valve has generally been located uphole from the annular safety valve mechanism. In those wells, access through the annular space between the casing and tubing to service the annular safety valve mechanism or other downhole equipment is obstructed. The tubing safety valve where attached with the tubing typically occupies a greater cross sectional area than does the tubing alone. Wellbore cross section is typically limited after casing and cementing is completed, therefore, space for downhole operations is confined to that limited area. The increased cross-sectional area of the tubing safety valve where attached with the tubing will, in many cases, not leave sufficient space for passage of downhole tools through the annular space between the casing and the tubing. Thus, in these described arrangements, the tubing safety valve must be removed in order to perform wellbore operations downhole of the tubing safety valve. The complications and hazards of that removal have been previously described.

The present invention overcomes these and other problems presented by the prior annular safety valves/tubing safety valve arrangements in wells completed for gas lift operation. Because the present invention overcomes those problems, the invention is believed to be a significant advance in that technology.

SUMMARY OF THE INVENTION

The invention is a safety system for an underground oil production well, the well having a downhole portion extending below ground beyond at least one area of production and a wellhead portion projecting above ground and being capable of allowing injection of gas for gas lift operation, comprising single stream means for transport of the oil being produced, together with any of the gas injected for gas lift operation which aerates the oil, from the downhole portion of the well at the at least one area of production towards the wellhead portion of the well; means for suspending the single stream means within the well so that the single stream means extends from below the wellhead portion to the at least one area of production; dual stream means for allowing simultaneous segregated transport of the oil being produced, together with any of the gas injected for gas lift operation, from the single stream means to the wellhead portion, and of any of the injected gas into the downhole portion for gas lift operation; and means for selectively sealing off the well to prevent flow from the well of the injected gas and the oil being produced from the well.

In another aspect, the means for sealing off is located, at least in part, within the dual stream means and each of the dual stream means and the means for sealing off is retrievable from within the well.

In yet another aspect, the single stream means includes a tubing string having gas injection valves incorporated therewith to allow the gas injected for gas lift operation to aerate the oil produced from the at least one area of production, causing the oil to better migrate upward within the tubing string from the downhole portion towards the wellhead portion.

In another aspect, the safety system further comprises a means for supporting at least some of the weight of the single stream means at a location within the well downward in the downhole portion from the means for suspending.

In even another aspect, the means for selectively sealing off includes a single stream sealing means which serves to selectively seal only the single stream means.

In another aspect, the means for suspending includes a casing nipple selectively positioned within the downhole portion, the casing nipple having a key profile formed thereon, and at least one key which allows the means for suspending to be rigidly secured within the downhole portion by engagement of the at least one key with the key profile, the engagement occurring as the means for suspending is lowered into the downhole portion and causing the single stream means to become suspended and restrained from further lowering in the downhole portion.

In even another aspect, the means for suspending includes at least two vertical passageways for segregated passage therethrough of each of the oil being produced, together with any of the gas injected for gas lift operation which aerates the oil, from the downhole portion towards the wellhead portion and the injected gas into the downhole portion below the means for suspending.

In a further aspect, positioning of the single stream means within the downhole portion creates an annular space outside the single stream means and inside the downhole portion and the means for selectively sealing off includes an annular space sealing means which serves to selectively seal the annular space.

In another aspect, the safety system further comprises a means for preventing each of the single stream means, the means for suspending, and the dual stream means from moving upward in the downhole portion towards the wellhead portion in response to buildup in the downhole portion of pressure from the at least one area of production.

In an even further aspect, the means for selectively sealing off includes at least one safety valve incorporated with the dual stream means, which at least one safety valve can independently seal off flow from the well of the oil being produced, together with the gas injected for gas lift operation which aerates the oil, and of the injected gas.

In another aspect, the safety system further comprises a means for release allowing each of the single stream means, the means for suspending, and the dual stream means to be retrieved from the downhole portion towards the wellhead portion.

In yet another aspect, the means for sealing off is retrievable, independent of each of the single stream means, the means for suspending, and the dual stream means, from the downhole portion towards the wellhead portion.

In an even further aspect, the dual stream means includes an uphole production tubing portion and a gas injection tubing affixed with the means for suspending to selectively allow segregated flows of the gas injected for gas lift operation and the oil being produced, together with any of the gas injected for gas lift operation which aerates the oil, through the means for suspending.

In another further aspect, the means for sealing off includes at least one tubing retrievable safety valve.

In an even further aspect, the single stream sealing means is at least one tubing retrievable safety valve affixed with the single stream means downhole from the means for suspending.

In yet another aspect, the means for suspending, when so rigidly secured, is restrained from both lowering and rising in the downhole portion.

In another aspect, the annular space sealing means is comprised at least in part of the means for suspending.

In a further aspect, the means for preventing includes at least one internal slip.

In another further aspect, the at least one safety valve is further characterized as being both a tubing retrievable safety valve incorporated for sealing off at least one of the dual streams of the dual stream means and a tubing retrievable safety valve incorporated for sealing off the other of the dual streams of the dual stream means.

In yet another aspect, the means for release includes a wireline release jar portion incorporated with the means for suspending, the wireline release jar portion, when activated by a wireline jar tool, being caused to trigger the means for release allowing each of the single stream means, the means for suspending, and the dual stream means to be retrieved from the downhole portion towards the wellhead portion.

In another aspect, the means for suspending is restrained from rising by at least one internal slip.

In yet another aspect, at least part of the means for suspending may be selectively released from being rigidly secured and thereafter be raised from the downhole portion.

In a further aspect, the wireline jar tool may be caused to activate the wireline release jar portion at least in part by passing of the wireline jar tool through the dual stream means in contact with the injected gas but not the oil being produced.

In another embodiment, the invention is a suspension apparatus for suspending tubing within a downhole portion of an oil production well, comprising means for coupling with the tubing and means for securing the means for coupling within the downhole portion.

In another aspect, the means for coupling incorporates at least one key and the means for securing incorporates at least one key profile which conforms with the at least one key, allowing the at least one key to become recessed within the key profile when the at least one key and the at least one key profile are caused to be contacted.

In another embodiment, the invention is a suspension apparatus for suspending tubing within a downhole portion of an oil production well, the well being capable of allowing simultaneous segregated transport therethrough of injection gas for gas lift operation and of oil production, together with any of the injection gas which aerates the oil production, comprising means for coupling with the tubing, the means allowing for segregated passage therethrough of the injection gas and of the oil production, together with any of the injection gas which aerates the oil production, and means for securing engageable with the means for coupling within the downhole portion to prevent the means for coupling from lowering within the downhole portion.

In a further aspect, the suspension apparatus further comprises a means for retention to prevent the means for coupling from rising within the downhole portion when the means for securing is engaged with the means for coupling.

In another aspect, the means for coupling incorporates at least one key and the means for securing incorporates at least one key profile which conforms with the at least one key, allowing the at least one key to become recessed within the key profile when the at least one key and the at least one key profile are caused to be contacted as the means for coupling with the tubing is lowered into the downhole portion, thereby engaging the means for securing with the means for coupling.

In yet another aspect, the suspension apparatus further comprises means for selectively sealing the means for coupling to independently prevent passage therethrough of the injection gas and of the oil production, together with any of the injection gas which aerates the oil production.

In even another aspect, the means for coupling and the means for securing may be selectively disengaged releasing the means for retention, thereby allowing the means for coupling and the means for retention to be retrieved upward from the downhole portion.

In a further aspect, the means for coupling, when the means for selectively sealing is caused to prevent passage through the means for coupling of each of the injection gas and the oil production, together with any of the injection gas which aerates the oil production, acts to seal the injection gas and the oil production, together with any of the injection gas which aerates the oil production, within the downhole portion.

In yet another aspect, the suspension apparatus further comprises means to maintain the injection gas and the oil production, together with any of the injection gas which aerates the oil production, segregated when sealed within the downhole portion.

In another embodiment, the invention is a retention apparatus for retaining downhole equipment within a downhole portion of an oil production well to prevent the equipment from rising within the downhole portion, the well being capable of simultaneous segregated transport therethrough of injection gas for gas lift operation and of oil production, together with any of the injection gas which aerates the oil production, comprising means for coupling with the equipment, the means allowing for segregated pass age therethrough of the injection gas and of the oil production, together with any of the injection gas which aerates the oil production, and means for retaining the means for coupling within the downhole portion to prevent the means for coupling from rising within the downhole portion.

In another aspect, the retention apparatus further comprises a means for securing, engageable with the means for coupling within the downhole portion to prevent the means for coupling from lowering within the downhole portion when the means for securing and the means for coupling are engaged.

In another aspect, the means for retention includes at least one internal slip.

In yet another aspect, the retention apparatus further comprises means for selectively sealing the means for coupling to independently prevent passage therethrough of the injection gas and of the oil production, together with any of the injection gas which aerates the oil production.

In even another aspect, the means for retention may be selectively released by disengaging the means for coupling and the means for securing, thereby allowing the means for coupling and the means for retention to be retrieved upward from the downhole portion.

In a further aspect, the means for coupling, when the means for selectively sealing is caused to prevent passage through the means for coupling of each of the injection gas and the oil production, together with any of the injection gas which aerates the oil production, acts to seal the injection gas and the oil production, together with any of the injection gas which aerates the oil production, within the downhole portion.

In an even further aspect, the retention apparatus comprises means to maintain the injection gas and the oil production, together with any of the injection gas which aerates the oil production, segregated when sealed within the downhole portion.

In another embodiment, the invention is a hanger mechanism for a well which is completed at least in part by a casing process in which casing is run into the well and by lowering production tubing into the well, comprising a casing nipple which may be run into the well with the casing and thereby selectively positioned within the well positioned; a stationary threaded tubing holder which may be run into the well with the tubing; and a means, connected with the stationary threaded tubing holder, for rigidly securing the stationary threaded tubing holder at the casing nipple when the stationary threaded tubing holder passes through the casing nipple as the stationary threaded tubing holder is run into the well, the means thereby preventing upward and downward movement of the stationary threaded tubing holder relative to the casing nipple.

In another aspect, the means for rigidly securing is selectively releasable to allow the stationary threaded tubing holder to be upwardly retrieved from the well.

In yet another aspect, the hanger mechanism further comprises means, incorporated with the stationary threaded tubing holder, for sealing off the well to prevent flows therefrom.

In even another aspect, the well is equipped for gas lift operation by injection of gas into an annular space between the casing and the tubing, which gas aerates fluids produced through the tubing.

In another aspect, the means for sealing of the well independently seals off the annular space and the tubing.

In yet another aspect, the casing nipple has at least one key profile formed on the inner cylindrical circumference thereof and the means for rigidly securing includes a sliding key carrier with at least one key for matching with the key profile, which sliding key carrier and at least one key is positioned between the casing nipple and the stationary threaded tubing holder and is secured to the stationary threaded tubing holder by a set pin as the stationary threaded tubing holder is run into the well.

In even another aspect, the means for rigidly securing includes at least one internal slip partially recessed in the staionary threaded tubing holder and abutting the sliding key carrier, the at least one internal slip preventing the stationary threaded tubing holder from moving upward in the well relative to the sliding key carrier.

In yet another aspect, when the at least one key is engaged with the at least one key profile as the stationary threaded tubing holder is run into the well, the sliding key carrier and the at least one key remain in particular relation with the casing nipple and further running of the stationary threaded tubing holder into the well causes the set pin to be sheared allowing the stationary threaded tubing holder to be moved downward in the well relative to the sliding key carrier.

In even yet another aspect, the stationary threaded tubing holder is further incorporated with a wireline release jar portion being in part an expander lock and, as the stationary threaded tubing holder is moved downward in the well relative to the sliding key carrier, the expander lock moves between the stationary threaded tubing holder and the sliding key carrier at the at least one key, thereby backing up the at least one key, preventing the at least one key from disengaging from the at least one key profile, and securing each of the stationary threaded tubing holder and the sliding key carrier in particular relation to the casing nipple and preventing the stationary threaded tubing holder and the sliding key carrier from moving downward in the well relative to the casing nipple.

In another aspect, the wireline release jar portion is incorporated with the stationary threaded tubing holder by a release pin connecting the stationary threaded tubing holder and the expander lock of the wireline release jar portion.

In a further aspect, the wireline release jar portion may be forced downward when the stationary threaded tubing holder and the sliding key holder are secured in particular relation to the casing nipple, thereby shearing the release pin and causing the wireline release jar portion to disconnect from the stationary threaded tubing holder allowing for upward retrieval of the stationary threaded tubing holder from the well.

In another embodiment, the invention is a method of sealing a well equipped for gas lift operation, the well providing for injection of gas for gas lift into an annular space between casing and tubing within the well, the gas aerating oil production migrating upward through the tubing, comprising the steps of running a casing nipple into the well with the casing and thereby selectively positioning the casing nipple within the well; running a stationary threaded tubing holder into the well with the tubing, through the casing nipple; providing the stationary threaded tubing holder with a means for rigidly securing the stationary threaded tubing holder at the casing nipple when the stationary threaded tubing holder passes through the casing nipple during the running of the stationary threaded tubing holder into the well, to prevent movement of the stationary threaded tubing upward and downward relative to the casing nipple; providing the stationary threaded tubing holder with a means for selectively sealing the annular space; and providing the tubing with a means for selectively sealing the tubing.

In another aspect, the method further comprises the step of providing the means for rigidly securing with a release mechanism for selective release of the means for rigidly securing to upwardly retrieve the stationary threaded tubing holder from the well.

In another embodiment, the invention is a method of performing downhole operations on a well equipped for gas lift operation, the well having a means for injecting gas into an annular space between casing and tubing to allow aeration of oil production migrating upward through the tubing and having both a means for sealing the annular space to prevent flows therefrom and a means for sealing the tubing to prevent flows there from, the method comprising the steps of entering the means for injecting gas and proceeding through the means for injecting gas into the annular space.

BRIEF DESCRIPTION OF THE DRAWINGS

For a complete understanding of the present invention and for further objects and advantages thereof, reference may now be had to the following description in conjunction with the accompanying drawings in which.

For ease of reference, the wells illustrated in each of FIGS. 1–4, 5A–D, 7 and 8 are shown oriented as uphole towards the top of the page.

DETAILED DESCRIPTION OF THE INVENTION

In order to fully understand the particular aspects of the present invention which enable the invention to overcome the problems presented by the prior technology and which it is believed, thus, make the invention a significant improvement over that technology, it is helpful to consider various arrangements of the prior technology oil and/or gas wells and their safety mechanisms. In the figures, certain similar or identical elements in the several figures are identified by the same numerals in each of the figures in which those elements appear.

Figures 1, 2, 3, 4:
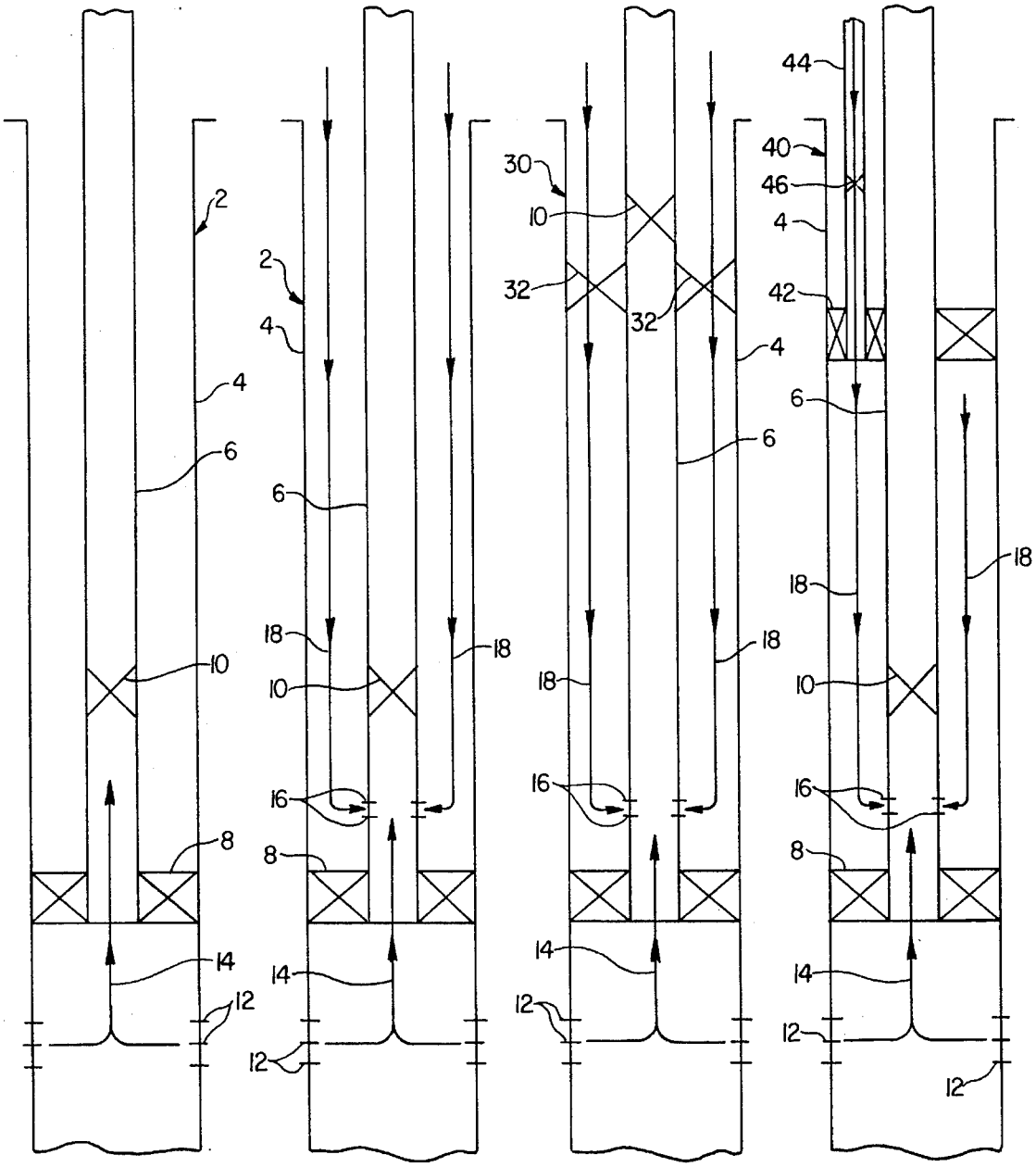
FIG. 1 (PRIOR ART)
FIG. 2 (PRIOR ART)
FIG. 3 (PRIOR ART)
FIG. 1 is a simplified, vertical cross-sectional view of a downhole portion of a typical, basic well completed for production of oil and/or gas.
FIG. 2 is a simplified, vertical cross-sectional view of a well similar to that of FIG. 1, except that the completed well allows for injection of gas into the well annular space between the casing and tubing to enter the tubing for gas-lift operation.
FIG. 3 is a simplified, vertical cross-sectional view of a well similar to that of FIG. 2 equipped with both an annular safety valve mechanism and a tubing safety valve mechanism.
FIG. 4 is a simplified, vertical cross-sectional view of a well illustrating the dual tubing streams allowing for simultaneous and segregated injection of gas lift gas and production of oil aerated by the gas, the suspended single production tubing stream, the safety valve mechanisms for selectively sealing off the annular space between production tubing and casing and the production tubing, and the mechanism which allows retrievability of the downhole equipment all of the present invention.

Referring first to FIG. 1, a simplified vertical cross-sectional view of a typical basic oil and/or gas well 2 is shown. This basic well 2 has been completed without gas injection capability. The well has a casing 4 which may be cemented in place within the wellbore of the well 2, in the manner previously described in more detail herein. Suspended vertically within the wellbore inside the casing 4 is a length of production tubing 6. The production tubing 6 extends at least from the top of the casing 2 downhole almost to a producing sedimentary formation (not shown) which has been drilled. At the lower end of the tubing 6, a packer 8 fills the annular space between the casing 4 and the tubing 6 to seal that space from the wellbore downhole therefrom. A tubing safety valve 10 is located in the tubing 6 at a location between the ends of the tubing 6. Below the lower end of the tubing 6 and the packer 8 is shown a series of perforations 12 in the casing 4 which allow flow of produced fluids, for example, oil production depicted by arrow 14, from the productive sedimentary formation into the wellbore. In operation of this basic well 2, oil production 14 flows from the productive sedimentary formation, through the perforations 12 into the casing 4 below the packers 8, then into the tubing 6 through which the oil production 14 migrates uphole to the ground surface. The oil production 14 is caused to flow in this manner due to a pressure gradient from higher pressure to lower pressure from downhole to uphole.

Referring next to FIG. 2, a basic gas lift well arrangement 20, similar to the well 2 in FIG. 1 but also including equipment for gas lift operation, is shown. As previously described, gas lift operation may be employed in certain wells to improve recovery. This well 20 also includes casing 4, tubing 6, packer 8, and tubing safety valve 10. In addition, however, the tubing 6 is equipped in a portion thereof, upwards from the packer 8 but downhole from the tubing safety valve 10, with a series of gas lift valves 16. The well 20 also provides some means (not shown) to allow for injection of gas 18 for gas lift into the annular space between the casing 4 and the tubing 6 uphole from the packer 8. In operation of this well 20, oil production 14 flows from a producing sedimentary formation (not shown) through the perforations 12 in the casing 4 and into the tubing 6. The gas lift valves 16 allow the injected gas 18 to pass into the tubing 6. As the oil production 14 flows into the tubing 6, the injected gas 18 entering the tubing 6 aerates the oil production 14. This aeration causes the oil production 14 to exert less pressure than the pressure within the producing sedimentary formation. The effect is a raising or lifting of the oil production 14 through the tubing 6 due to the resulting pressure differential. This type of gas lift equipped well 20 may be desirable, for example, in old, deep, or other types of wells in which the pressure from the producing sedimentary formation is not sufficient to cause the oil production 14 to adequately migrate uphole through the tubing 6 to the ground surface.

Referring now to FIG. 3, the basic gas lift well arrangement 20 of FIG. 2 is shown equipped with an annular safety mechanism. This well 30 includes annular safety valves 32 as employed in the prior technology wells incorporating an annular safety mechanism. As with the basic gas lift well arrangement 20 of FIG. 2, this prior technology annular safety mechanism equipped well 30 includes casing 4, production tubing 6, packer 8, and a tubing safety valve 10. This well 30 also includes gas lift valves 16 which allow injected gas 18 to aerate oil production 14 flowing through perforations 12 into the wellbore from a producing sedimentary formation ( not shown). In addition to those elements, however, this well 30 also includes annular safety valves 32 typically located downhole from the tubing safety valve 10. The annular safety valves 32 allow flow of fluids, for example, injected gas 18 during gas lift operation, through the annular space between the casing 4 and the tubing 6. However, in the event of triggering occurrences, for example, events indicative of potentially hazardous situations, the annular safety valves 32 seal off and restrict the flow of fluids, such as injected gas 18, within that annular space. The annular safety valves 32 would typically be caused to close, sealing off the annular space, upon detection of excessive pressure, threatening fire, or other similar conditions. When the annular safety valves 32 are caused to close, the resulting sealing off of the annular space between the tubing 6 and casing 4 prevents escape from the annular space of injected gas 18 and/or other wellbore fluids within the wellbore. As previously described in more detail, this prior technology well arrangement 30 of annular safety valves 32 results in a number of problems in operation of the well 30. Those problems typically become apparent in downhole operations and include, for example, complexities and hazards of removal and repair of the annular safety valves, potential damage to well equipment or obstructed access in the case of lowering tools through production tubing to avoid annular safety valves, and restricted access in the wellbore due to downhole equipment arrangement.

Referring now to FIG. 4, a completed well 40 having the wireline release hanger with gas injection aspects of the present invention is shown. This well 40 overcomes the problems of the prior technology and so is believed to be a significant advance. This well 40 includes the casing 4, production tubing 6, packer 8, and tubing safety valve 10 of the other well arrangements 2, 20, 30. The tubing safety valve 10 employed with this well 40 is preferably a tubing retrievable safety valve. The well 40 allows for gas lift operation by providing gas lift valves 16. As in the prior technology wells equipped with gas lift equipment 20, 30, oil production 14 flows through perforations 12 in the casing 4 from a producing sedimentary formation (not shown) and into the production tubing 6. Injected gas 18 within an annular space between the tubing 6 and casing 4 then passes through the gas lift valves 16 to aerate the oil production 14 flowing in the tubing 6. This aeration effects an increased differential between the pressure of the oil production 14 flowing in the tubing 6 and the pressure of the producing sedimentary formation, thereby causing the oil production 14 so aerated to better migrate upwards through the tubing 6 to the surface. In addition to those similar or identical elements, however, this well 40, in a preferred embodiment, is equipped with a wireline release hanger with gas injection mechanism 42 of the present invention. The wireline release hanger with gas injection mechanism 42 is incorporated with a means, preferably gas injection tubing 44, allowing for injection of gas 18 into the annular space between the tubing 6 and casing 4.

Still referring to FIG. 4, the wireline release hanger with gas injection mechanism 42 of the, present invention is seen to fill a short length of the annular space between the production tubing 6 and the casing 4. The mechanism 42 allows for gas 18 to be injected below the mechanism 42, for example, via gas injection tubing 44. When gas 18 is so injected, the gas 18 flows into the annular space between the tubing 6 and casing 4, which annular space is, in the preferred embodiment, bounded at bottom by thee packer 8 and at the top by the wireline release hanger with gas injection mechanism 42. The packer 8 and the mechanism 42 each seal off the annular space, the mechanism 42, however, normally allowing for gas to be injected below the mechanism 42 into the annular space by a means incorporated with the mechanism 42 therefor but acting instead to seal off the annular space when that means is wholly obstructed and wellbore fluids are prevented from passing through the means. The means allowing for injection of gas 18, for example, gas injection tubing 44, may be caused to be so obstructed by a safety valve means, for example a gas injection safety valve 46 incorporated with the gas injection tubing 44 in the preferred embodiment. The safety valve means may, independently of the tubing safety valve 10, be caused to close, sealing off flows from the wellbore through the annular space. The gas injection safety valve 46 of the preferred embodiment is preferably triggered to close upon detection of certain occurrences, for example, events indicative of potentially hazardous situations such as excess pressure, threatening fire, or other conditions. When the gas injection safety mechanism, for example, such a gas injection safety valve 46, is triggered to close, gas 18 which has been injected into the annular space within the casing 4 and tubing 6 is sealed within the annular space between the packer 8 and the wireline release hanger with gas injection mechanism 42.

Still referring to FIG. 4, it becomes apparent that in order for the wireline release hanger with gas injection mechanism 42 to act as a seal of the annular space between the casing 4 and tubing 6 when the mechanism's 42 means allowing for injection of gas 18 is obstructed by closure of the safety valve means, the mechanism 42 must be in some manner rigidly securable within the wellbore to prevent uphole movement due to pressures within the annular space. A preferred embodiment of a manner in which the mechanism 42 is so rigidly securable to prevent uphole movement is hereinafter more fully described. In addition to being rigidly securable to prevent uphole movement, the mechanism 42, in the preferred embodiment hereinafter more fully described, is also rigidly securable within the wellbore sufficient to prevent downhole movement and to allow for the tubing 6 to be suspended in the wellbore from the mechanism 42. Though not shown in FIG. 4, the wireline release hanger with gas injection mechanism 42 also allows for the mechanism 42, together with other downhole production equipment, to be run downhole into the wellbore until the mechanism 42 is appropriately located in the wellbore for rigid securement and to be released from rigid securement within the wellbore for uphole retrieval of the mechanism 42, together with other downhole production equipment. The preferred embodiment of the mechanism 42 and the well 40 which allow for these downhole and uphole movements and the securement is hereinafter more specifically described.

Continuing to refer to FIG. 4 and in light of the prior discussion, the advantages of the present invention over the prior technology become apparent. In particular, those advantages include: the ability to easily remove and repair the safety valve means, in particular, where that mechanism is a gas injection safety valve 46 which is incorporated with and retrievable through gas injection tubing 44; relatively easy and unobstructed access downhole in the wellbore through the annular space between casing 4 and tubing 6 via a gas injection tubing 44 serving to allow for injection of gas into the annular space below the wireline release hanger with gas injection mechanism 42; and location of the tubing safety valve 10 downhole from the mechanism 40 so that the tubing safety valve 10 does not restrict access in the wellbore, such location being made possible since the mechanism 42 and gas injection tubing 44 arrangement allows access to the wellbore through the annular space. In addition to those advantages, the present invention, in a preferred embodiment, allows for lowering of the mechanism 42 downhole through the casing 4, location and rigid securement of the mechanism 42 in the wellbore to prevent both upward and downward movement, suspension of tubing 6 from the mechanism 42 within the wellbore, sealing of the annular space between the casing 4 and tubing 6 by cooperation of the mechanism 42 and a safety valve means incorporated therewith, and release of the mechanism 42 from rigid securement in the wellbore to allow uphole retrieval of the mechanism 42 and other downhole equipment. These advantages will become more apparent and fully understood in the remaining portions of this description, which portions describe a preferred embodiment of the present invention.

Now referring to FIGS. 5A, 5B, 5C, and 5D, a more detailed vertical cross-sectional depiction of the well 40 of FIG. 4 is shown. The preferred embodiment of the wireline release hanger with gas injection mechanism 42 is depicted in its rigid securement (referred to herein as "set position") in the wellbore, in particular, in FIG. 5A. This preferred embodiment of the wireline release hanger with gas injection mechanism 42 consists of a casing nipple 50 which must be run with the casing 4 as the casing 4 is placed within the wellbore. The casing nipple 50 is a short length of casing material of wider diameter than the casing 4, which casing 4 is comprised more specifically of an uphole casing portion 70 and downhole casing portion 72. The casing nipple 50 is equipped at both ends with threading on the inside circumference. This threading corresponds with screw threadings at the ends on the outside circumference of each of the uphole casing portion 70 and downhole casing portion 72 where they flange with the casing nipple 50. The inner circumference of the casing nipple 50 at a location between the ends of the casing nipple 50 are formed with a series of key profiles 54. These key profiles 54 are particularly configured to accept and retain keys 52 as hereinafter more fully described.

Figure 5A:
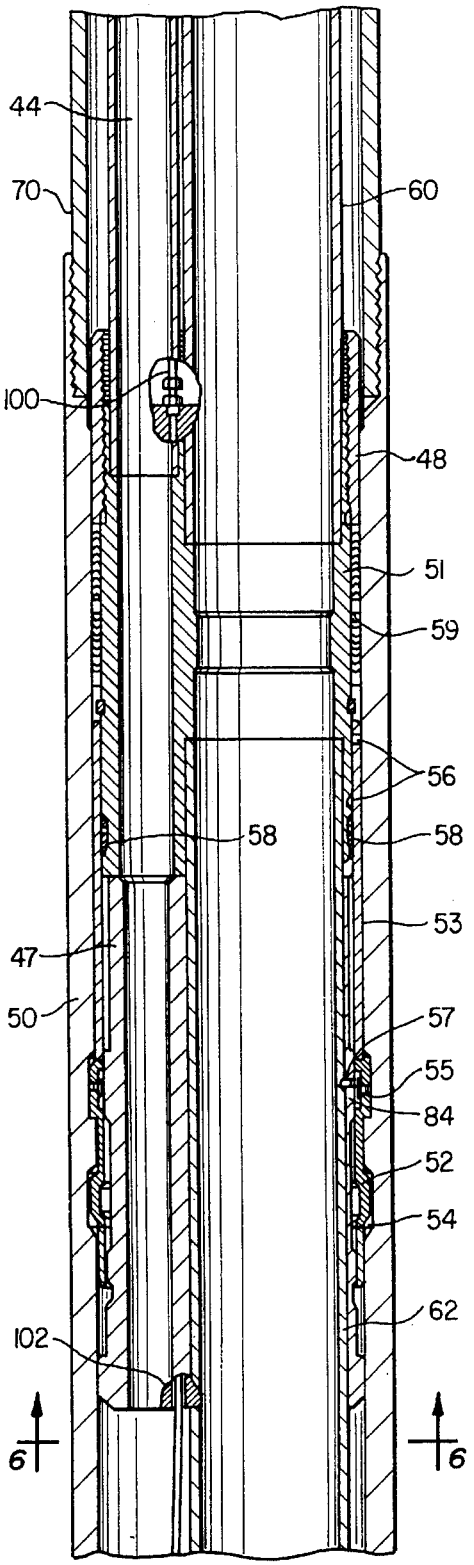
FIGS. 5A–D are detailed cross-sectional views along the length of the downhole portion of a well incorporating the preferred embodiment of the various aspects of the present invention.

Still referring to FIG. 5A, the preferred wireline release hanger with gas injection mechanism 42 is seen to further comprise a solid piece, stationary threaded tubing holder 51. The stationary threaded tubing holder 51 further includes a wireline release jar portion 47 and a key backup portion 84. The stationary threaded tubing holder 51 further includes at least two vertically extending cylindrical holes therethrough which correspond with the production tubing 6, which production tubing 6 is further characterized as including an uphole production tubing portion 60 and a downhole production tubing portion 62, and the gas injection tubing 44 which corresponds with the wireline release jar portion 47 thereby providing that vertical passageway. The stationary threaded tubing holder 51 may additionally be provided with other passageways, for example, for passage of a control line 100 through a control line passage 102 therethrough. With the exception of these vertical passages through the stationary threaded tubing holder 51, the stationary threaded tubing holder 51 is generally cylindrical with almost the same cross-sectional area as the inside of the casing nipple 50 at locations other than where the key profiles 54 are formed therein.

Continuing to refer to FIG. 5A, the inner surfaces of the vertical passages through the stationary threaded tubing holder 51 are equipped with threadings which correspond with screw threadings of the production tubing 6 and the gas injection tubing 44. When it becomes appropriate during the well completion process to run the mechanism 42 down into the wellbore, the threadings of the stationary threaded tubing holder 51 serve for flanging up the downhole production tubing portion 62, the uphole production tubing portion 60, and the gas injection tubing 44 with the holder 51. By so coupling the stationary threaded tubing holder 51 with that tubing 62, 60, 44, the holder 51 may serve to suspend the downhole production tubing portion 62, as hereinafter more particularly described, and may be run into the wellbore along with the tubing 6.

Still continuing to refer to FIG. 5A, the stationary threaded tubing holder 51 is fitted within a hollow, cylindrical sliding key carrier 53 of slightly larger inner diameter than that of the stationary threaded tubing holder 51 and of slightly smaller outer diameter than that of the casing nipple 50. The sliding key carrier 53 contains floating segments of keys 52 which have a bias in a radially outward direction from the longitudinal axis of the sliding key carrier 53 due to key springs 55 positioned therewith. As will be hereinafter more fully described, the key profiles 54 of the casing nipple 50 serve as recesses which match the profile of the keys 52.

The keys 52 may be compressed to allow the entire assembly of the stationary threaded tubing holder 51, keys 52, and sliding key carrier 53 to slide downward within the uphole casing portion 70 and casing nipple 50 until the keys 52 reach the key profiles 54 of the casing nipple 50. This allows the wireline release hanger with gas injection mechanism 42 to be run downward into the wellbore through the uphole casing portion 70 until selectively positioned therein. When the keys 52 reach the key profiles 54, the outward bias of the keys 52, due to the key springs 55, causes the keys 52 to match the recessed key profiles 54 and become outwardly engaged therein. When the keys become so engaged, the keys 52 cause the sliding key carrier 53 to remain stationary with respect to the casing nipple 50.

If at that point where the sliding key carrier 53 is caused to remain stationary the mechanism 42 is continued by force to be run downward into the wellbore, then a set pin 56 which holds the sliding key carrier 53 in select relation to the stationary threaded tubing holder 51 is sheared. The shearing of the set pin 56 causes the stationary threaded tubing holder 51 to move downward in relation to the sliding key carrier 53 and keys 52 assembly until an expander lock 84 portion connected with the stationary threaded tubing holder 51 wedges the keys 52 within the recessed key profiles 54 of the casing nipple 50. This wedging of the keys 52 creates a very strong and rigid securement of the stationary threaded tubing holder 51 with the casing nipple 50 in that position within the wellbore. This securement maintains that particular relation of the casing nipple 51 and mechanism 42, together with any downhole production tubing portion 62 suspended from the stationary threaded tubing holder 51. This affixing and suspension at locations of a casing nipple 50 in a string of casing 4 may be selectively employed to distribute tubing 6 weight throughout the vertical length of a well hole casing 4. As may be further noted, the key backup portion 84 is held in a select relation with the stationary threaded tubing holder 51 in this instance, at least in part, by a release pin 57. This release pin 57 contributes to the retrievability aspects of the present invention as hereinafter more fully described.

Continuing to refer to FIG. 5A, it may be seen that the stationary threaded tubing holder 51 is also equipped with internal slips 58. Several of these internal slips 58 are placed along the outer circumference of the stationary threaded tubing holder 51 in recesses formed therein for those slips 58. The slips 58 are formed with gripping teeth along the radially positioned outward edges thereof. Because of the shape of the recesses in which the internal slips 58 are positioned in the stationary threaded tubing holder 51 outer circumference, the internal slips 58 grip the internal circumference of the sliding key carrier 53 as the sliding key carrier 53 is subjected to upward force (i.e., force directed to the top of the page in FIG. 5A), for example, due to downhole production fluid pressures, and as the stationary threaded tubing holder 51 is subjected to downward force (i.e., force directed to the bottom of the page in FIG. 5A), for example, due to the weight of the casing 4 suspended from the stationary threaded tubing holder 51.

Figure 5B:
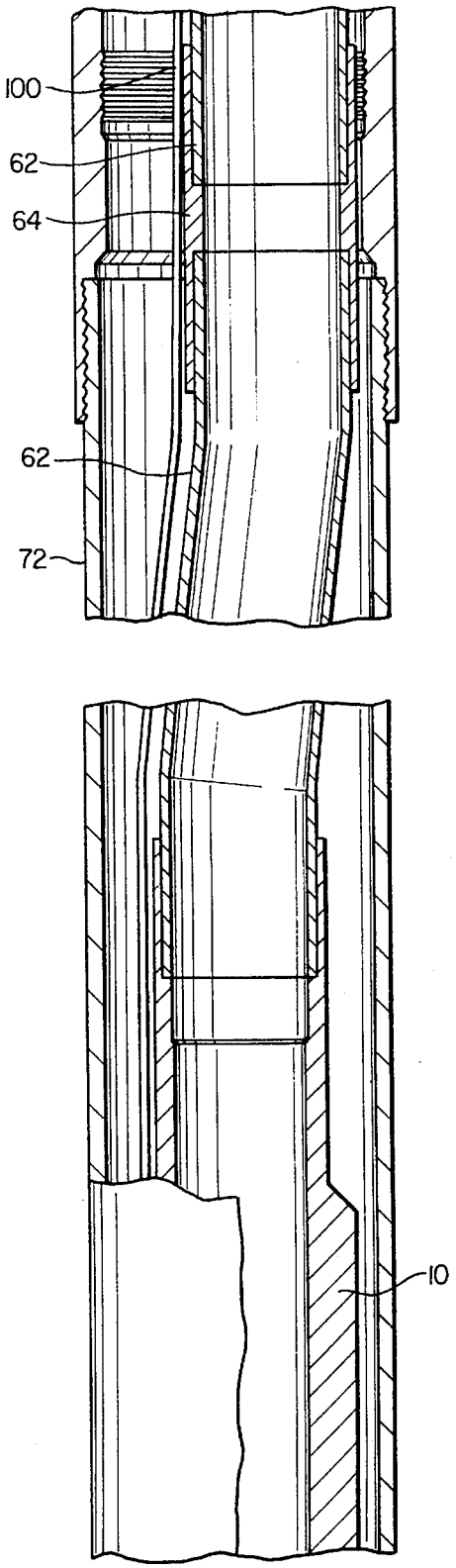
Figure 5C:
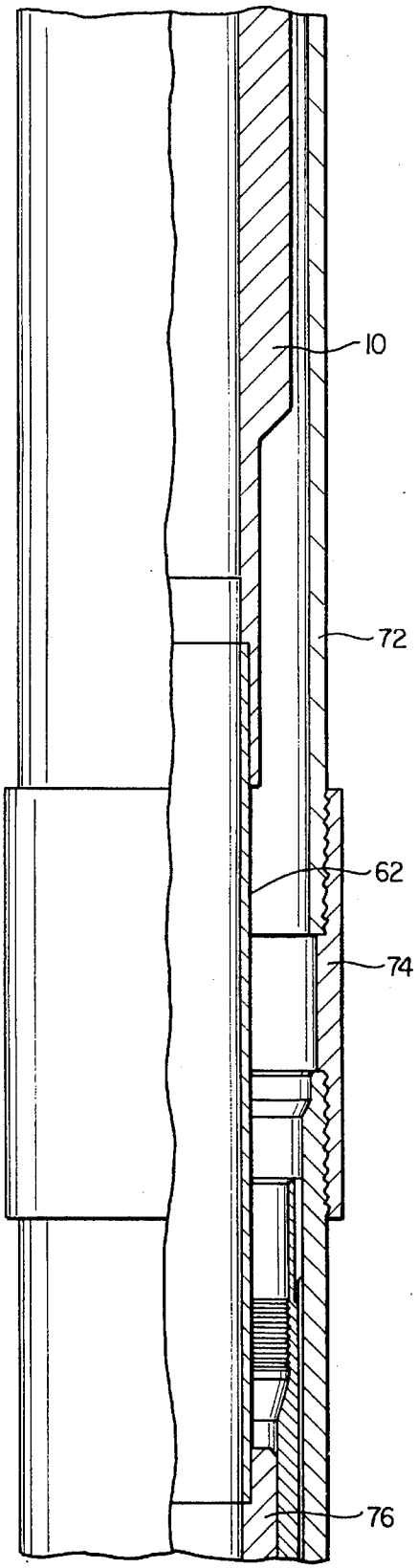
Figure 5D:
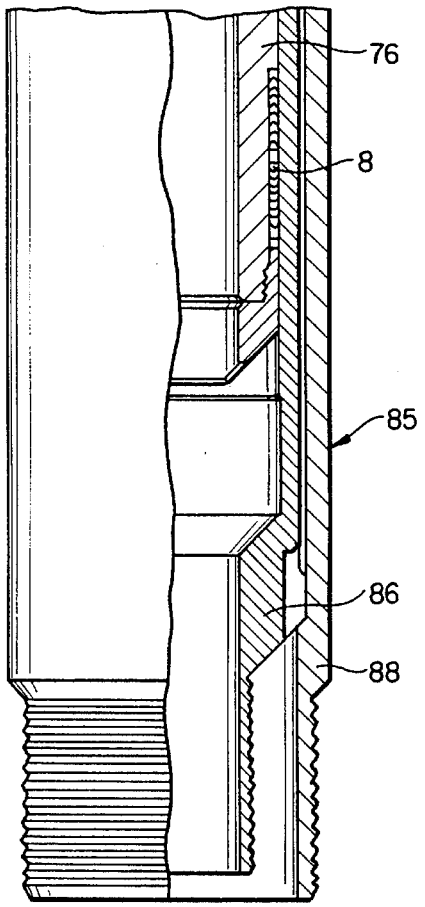

Next referring to FIGS. 5B, 5C and 5D, the portion of the tubing string 6 and casing 4 located downhole from the wireline release hanger with gas injection mechanism 42 of FIG. 5A is shown. In that portion, the downhole casing portion 72 internally contains the downhole production tubing portion 62 which is shown affixed with a tubing safety valve 10. Also seen within the downhole production tubing portion 62 which is shown affixed with a tubing safety valve 10. Also seen within the downhole casing portion 72 is the control line 100 which extends through the passageway in the stationary threaded tubing holder 51 (shown in FIG. 5A). The matters shown in FIGS. 5B, 5C, and 5D are intended only as an example of a typical well completion in which the present invention may be employed. It will be readily understood by those skilled in the art that the particular elements shown in those figures may differ according to particular aspects and desired results of the well completion. Consequently, all of those differing elements are also included in the invention.

Still referring to FIGS. 5C–D, even further downhole sections of the casing 4 and tubing 6 are shown. Again, those figures are intended only to be exemplary and other completion configurations and equipments are also included in the invention. In the example completion, the illustrated downhole section includes a casing joint 74 which is shown to join separate links of the downhole casing portion 72. The drawing further illustrates the downhole production tubing portion 62 at its lower-most extension where there is located a packing mandrel 76 and packing 8 which seals the annular space between the downhole production tubing portion 62 and the No Go shoulder 86 to prevent production fluids from flowing upwardly into this annular space. In this particular exemplary arrangement of the completed well 40 of the present invention, the casing 4 at its lower-most extension includes a No Go hanger 86, 88. The No Go hanger 86, 88 includes a No Go casing nipple 88 which is coupled with the downhole casing portion 72 by a casing joint 74 and serves to further support the downhole production tubing portion 62 which is coupled with a No Go shoulder 86. The NO Go hanger 86, 88 supports the downhole production tubing portion 62 once that portion 62 is lowered into the hole until the No Go shoulder 86 abuts the No Go casing nipple 88. The No Go casing nipple 88 prevents the No Go shoulder 86 from further proceeding downhole and supports the weight thereon.

Figure 6:
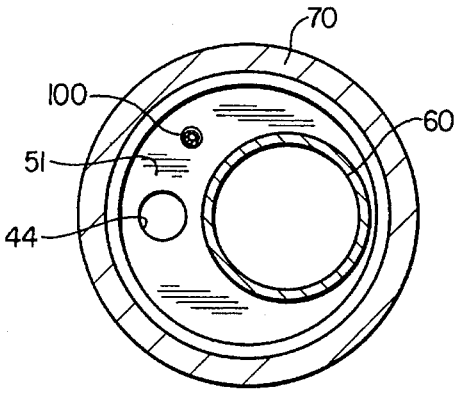
FIG. 6 is a detailed cross-sectional view of the well of FIGS. 5A–D taken along lines 6—6 of FIG. 5A, showing an uphole view of the location of the production tubing, the gas injection tubing, and the control line within the cross-section of the downhole portion of a well incorporating the preferred embodiment of the various aspects of the present invention.

Now referring to FIG. 6, a horizontal cross-section of the wireline release hanger with gas injection mechanism 42 along line 6—6 of FIG. 5A is shown. This cross-section illustrates the relative positioning below the stationary threaded tubing holder 51 and within the inside of the uphole casing portion 70 of the uphole production tubing portion 60, the gas injection tubing 44, and the control line 100. The depiction also shows how lower-most edge of the stationary threaded tubing holder 51 occupies substantially all the remaining cross-sectional area of the uphole casing portion 70 which does not correspond with the passageways for the uphole production tubing portion 60, the gas injection tubing 44, or the control line passage 102 for the control line 100.

Figure 7:
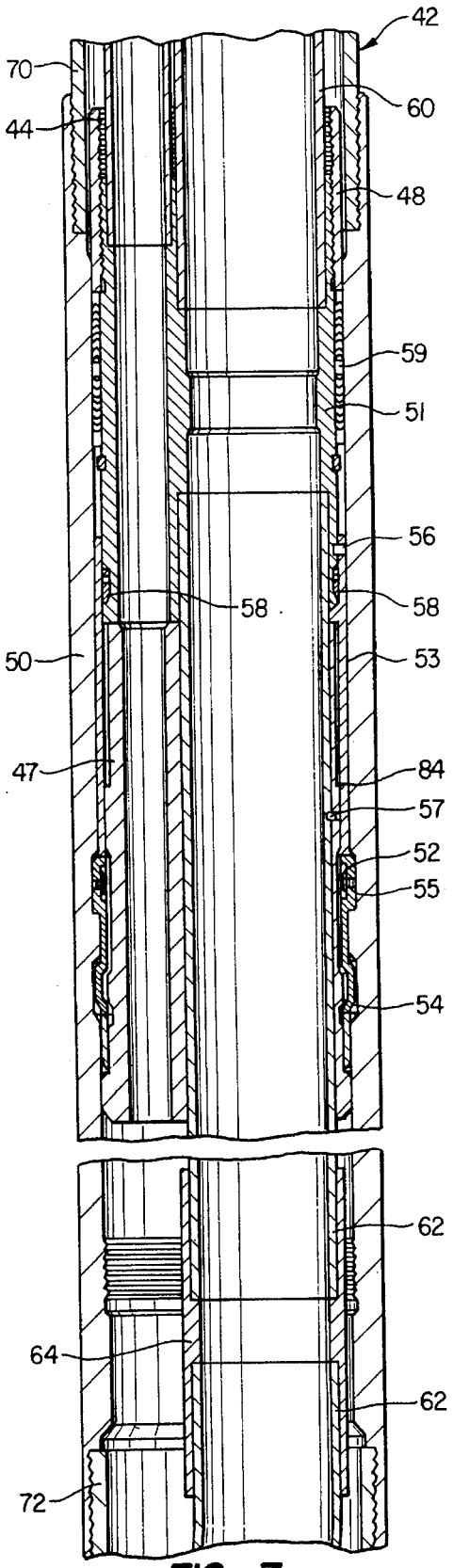
FIG. 7 is a detailed, partial, vertical cross sectional view of the dual stream wireline release hanger with gas injection mechanism of the preferred embodiment of the present invention when in run position.

Next referring to FIG. 7, the wireline release hanger with gas injection mechanism 42 of the present invention is shown in run position as the injection mechanism 42 and tubings 62, 60, 44 are being lowered into the wellbore through the casing 4. It may be seen that in this run position, the wireline release hanger with gas injection mechanism 42 includes the sliding key carrier 53 and keys 52 securely positioned in relation to the stationary threaded tubing holder 51 by the set pin 56. Further in this run position, it is seen that the expander lock 84 is retained in particular relative position with the downhole production tubing portion 62 and, thus, also with the stationary threaded tubing holder 51 and the sliding key carrier 53 and keys 52, by the release pin 57. In this manner, the wireline release hanger with gas injection mechanism 42 may be freely raised and lowered at will. Once lowered so that the keys 52 become positioned within the key profile 54 of the casing nipple 50 and further force is continued to be applied downward, the set pin is sheared (see FIG. 5A).

Next referring back to FIG. 5A, the wireline release hanger with gas injection mechanism 42 of the present invention is shown in set position. In this set position, it is seen that the set pin 56 has been sheared thus allowing the expander lock 84 to be further forced downward along with the stationary threaded tubing holder 51 and tubings 62, 60, 44 until the expander lock 84 backs up the keys 52. As the expander lock 84 backs up the keys 52, the keys 52 rigidly secure the mechanism 42 within the wellbore and prevent further downward movement of the mechanism 42 and tubing 62, 60, 44 assembly. With the keys 52 so set within the key profiles 54, the casing nipple 50 bears the weight of the downhole production tubing portion 62 extending downhole therefrom and, by the mechanism 42, suspends such portion thereat.

Figure 8:
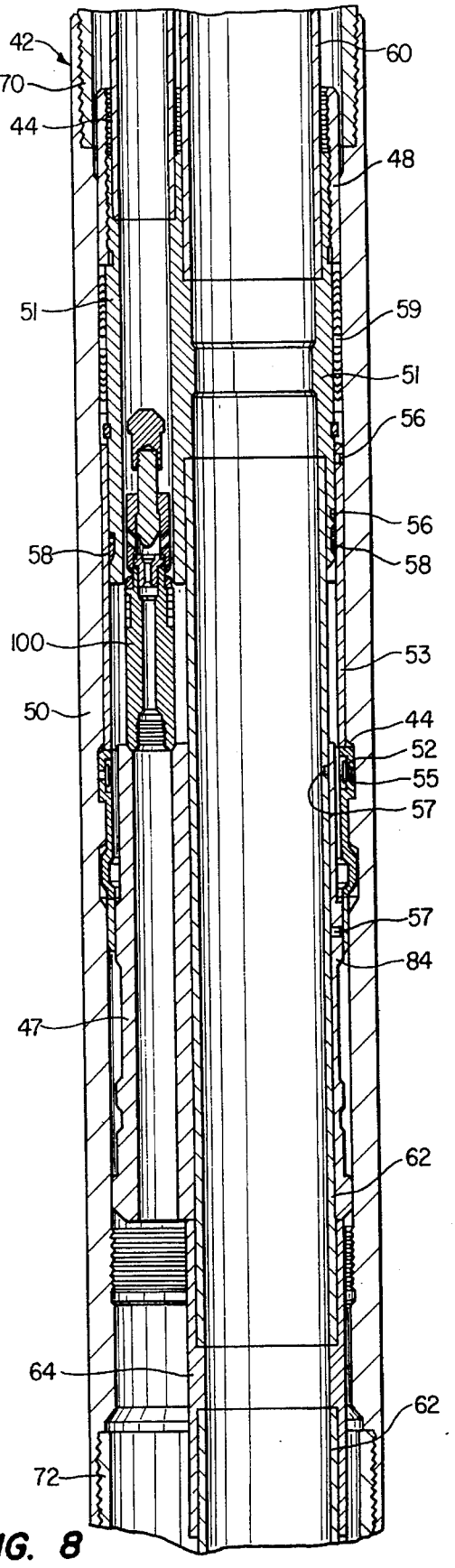
FIG. 8 is a detailed, partial, vertical cross sectional view of the dual stream wireline release hanger with gas injection mechanism of the preferred embodiment of the present invention in release position, depicting a wireline jar tool which has triggered the release mechanisms of the wireline release hanger with gas injection mechanism to allow for upward retrieval of the downhole equipment from the wellbore.

Referring now to FIG. 8, the wireline release hanger with gas injection mechanism 42 of the present invention is illustrated in release position in which the uphole production tubing 60, gas injection tubing 44, stationary threaded tubing holder 51, sliding key carrier 53 with keys 52, and downhole production tubing portion 62 may be lifted and removed from within the casing 4. In releasing the wireline release hanger with gas injection mechanism 42, a wireline jar tool 110 is lowered through the gas injection tubing 44 and through the corresponding passageway in the stationary threaded tubing holder 51 and the wireline release jar portion 47 thereof. The wireline jar tool 110 comes to rest atop the wireline release jar portion 47 of the stationary threaded tubing holder 51 because that wireline release jar portion 47 has a smaller inner diameter than the gas injection tubing 44. The wireline jar tool 110 may then mechanically, hydraulically and/or by pressure be caused to jar down the wireline release jar portion 47 of the stationary threaded tubing holder 51.

Continuing to refer to FIG. 8, it is shown that the wireline release jar portion 47 of the stationary threaded tubing holder 51 contains the expander lock 84. Because the jar down moves the expander lock 84 from its location at the keys 52, the keys once again become collapsible (although with a continuing but slight outward bias due to the key spring 55) sufficient to again allow the sliding key carrier 53 to be moved uphole within the casing nipple 50. Because the slips 58 disposed in the outward recesses of the stationary threaded tubing holder 51 abut the inner circumference of the sliding key carrier 53, the internal slips 58 retain the sliding key carrier 53 in a particular relative position to the stationary threaded tubing holder 51. However, because the sliding key carrier 53 and keys 52 are now movable upward within the casing 4, the entire assembly comprising the stationary threaded tubing holder 51 with coupled gas injection tubing 44, uphole production tubing portion 60, and downhole production tubing portion 62, as well as the sliding key carrier 53 with keys 52, may be lifted upward within the casing 4 and, if necessary, removed from the wellbore at the surface.

This herein described preferred embodiment of the wireline release hanger with gas injection mechanism 42 of the present invention, thus, provides for the advantages previously detailed. In the manufacture of the wireline release hanger with gas injection mechanism 42, all parts are preferably formed of materials such as solid, strong steel, iron, composition, or combinations thereof. The parts are also preferably cast and precision machined to provide for maximum strength and minimal tolerances.

As is clearly seen, the present invention overcomes the problems presented by the prior devices and methods for annular safety mechanisms in oil production wells completed for gas lift operation. The present invention is believed to be especially effective when manufactured and employed as described herein, however, those skilled in the art will readily recognize that numerous variations and substitutions may be made in the device and its use and manufacture to achieve substantially the same results as achieved by the embodiments and, in particular, the preferred embodiment expressly described herein. Each of those variations is intended to be included in the description herein and forms a part of the present invention. The foregoing detailed description is, thus, to be clearly understood as being given by way of illustration and example only, the spirit and scope of the present invention being limited solely by the appended claims.

What is claimed is:

1. A safety system for an underground oil production well, said well having a downhole portion extending below ground beyond at least one area of production and a wellhead portion projecting above ground, said well being capable of allowing injection of gas for gas lift operation, comprising:

first means for transporting said oil being produced, together with said gas injected, if any, for gas lift operation which aerates said oil, from said downhole portion of said well at said at least one area of production towards said wellhead portion of said well, said first means being located within said downhole portion;

means for suspending said first means within said well so that said first means extends from below said wellhead portion to said at least one area of production, said means for suspending being connected with said first means and affixed with said well;

second means for simultaneously and segregatedly transporting of said oil being produced, together with said gas injected, if any, for gas lift operation, from said first means to said wellhead portion, and of said gas injected, if any, into said downhole portion for gas lift operation, said second means being connected with said means for suspending thereabove within said downhole portion; and sealing means, operable upon said second means or upon each of said first means and said second means, for selectively sealing said well to prevent flow from said well of said injected gas and said oil being produced from said well.

2. The safety system of claim 1, wherein said sealing means is located, at least in part, within said first means and said second means and said sealing means is securable within and retrievable from within said well.

3. The safety system of claim 2, wherein said second means includes an uphole production tubing portion and a gas injection tubing each affixed with said means for suspending, said means for suspending allows segregated flow therethrough of said gas injected for gas lift operation passed through said gas injection tubing and said oil being produced, together with any of said gas injected for gas lift operation which aerates said oil, passed through said uphole production tubing portion.

4. The safety system of claim 2, wherein said sealing means includes at least one tubing retrievable safety valve.

5. The safety system of claim 1, wherein said second means includes a tubing string having gas injection valves incorporated therewith to allow said gas injected for gas lift operation to aerate said oil produced from said at least one area of production, causing said oil to better migrate upward within said tubing string from said downhole portion towards said wellhead portion.

6. The safety system of claim 1, further comprising a means for supporting at least some of the weight of said second means at a location within said well downward in said downhole portion from said means for suspending, said means for supporting being affixed with said well.

7. The safety system of claim 1, wherein said sealing means includes a second sealing means which serves to selectively seal only said second means.

8. The safety system of claim 7, wherein said second sealing means comprises at least one tubing retrievable safety valve affixed with said second means downhole from said means for suspending.

9. The safety system of claim 1, wherein said means for suspending includes a casing nipple selectively positioned within said downhole portion, said casing nipple having a key profile formed thereon, and at least one key which allows said means for suspending to be rigidly secured within said downhole portion by engagement of said at least one key with said key profile, said engagement occurring as said means for suspending is lowered into said downhole portion and causing said second means to become suspended and restrained from further lowering in said downhole portion.

10. The safety system of claim 9, wherein said means for suspending, when so rigidly secured, is restrained from both lowering and rising in said downhole portion.

11. The safety system of claim 10, wherein said means for suspending is restrained from rising in said well by at least one internal slip of said means for suspending.

12. The safety system of claim 10, wherein at least part of said means for suspending may be selectively released from being rigidly secured within said downhole portion and thereafter be raised from said downhole portion.

13. The safety system of claim 1, wherein said means for suspending includes at least two vertical passageways for segregated passage therethrough of said oil being produced, together with said gas, if any, injected for gas lift operation which aerates said oil, from said downhole portion towards said wellhead portion and said injected gas into said downhole portion below said means for suspending.

14. The safety system of claim 1, wherein said second means is positioned within said downhole portion to form an annular space between said second means and said downhole portion, said second means extending longitudinally within said downhole portion, and said sealing means includes an annular space sealing means which serves to selectively seal said annular space.

15. The safety system of claim 14, wherein said annular space sealing means is comprised at least in part of said means for suspending.

16. The safety system of claim 1, further comprising a means for preventing each of said second means, said means for suspending, and said first means from moving upward in said downhole portion towards said wellhead portion in response to pressure buildup in said downhole portion from said at least one area of production.

17. The safety system of claim 16, wherein said means for preventing includes at least one internal slip.

18. The safety system of claim 1, wherein said sealing means includes at least one safety valve operatively fixed with said first means, which at least one safety valve can independently seal off flow from said well of said oil being produced, together with said gas injected for gas lift operation which aerates said oil, and of said injected gas which does not aerate said oil.

19. The safety system of claim 18, wherein said first means allows passage of segregated dual streams and said at least one safety valve is further characterized as being both a tubing retrievable safety valve capable of sealing off at least one of said dual streams of said first means and a tubing retrievable safety valve capable of sealing off the other of said dual streams of said first means.

20. The safety system of claim 1, further comprising a means for release incorporated of said second means, said means for suspending, and said first means, allowing each of said second means, said means for suspending, and said first means to be retrieved from said downhole portion towards said wellhead portion.

21. The safety system of claim 20, wherein said means for release includes a wireline release jar portion incorporated with said means for suspending, said wireline release jar portion, when activated by a wireline jar tool, being caused to trigger said means for release allowing each of said second means, said means for suspending, and said first means to be retrieved from said downhole portion towards said wellhead portion.

22. The safety system of claim 21, wherein said wireline jar tool may be caused to activate said wireline release jar portion at least in part by passing of said wireline jar tool through said dual stream means in contact with said injected gas but not said oil being produced.

23. The safety system of claim 1, wherein said sealing means is retrievable, independent of each of said first means, said means for suspending, and said second means, from said downhole portion towards said wellhead portion.

24. A suspension apparatus for suspending tubing within a downhole portion of an oil production well, said well being capable of allowing simultaneous segregated transport therethrough of injection gas for gas lift operation and of oil production, together with any of said injection gas which aerates said oil production, comprising:

first means, for coupling with an end of said tubing, and allowing for segregated passage through said means of said injection gas, if any, and of said oil production, together with said injection gas, if any, which aerates said oil production;

second means for securing said first means within said well, said second means engages with said well and with said first means to prevent said first means from lowering within said downhole portion;

means for retaining said first means in engagement with said second means to prevent said first means from rising within said downhole portion after said second means is engaged with said first means;

means for selectively sealing said first means to independently prevent passage therethrough of said injection gas and of said oil production, together with any of said injection gas which aerates said oil production;

wherein said first means, when said means for selectively sealing is caused to prevent passage through said first means of each of said injection gas, if any, and said oil production, together with said injection gas, if any, which aerates said oil production, acts to seal said injection gas and said oil production, together with said injection gas which aerates said oil production, within said downhole portion.

25. The suspension apparatus of claim 24, further comprising means for segregating said injection gas, if any, and said oil production, together with said injection gas, if any, which aerates said oil production, when sealed within said downhole portion.

* * * * *